United States Patent [19]

Klisch

[11] Patent Number: 4,619,168

[45] Date of Patent: Oct. 28, 1986

[54] CUTTING MECHANISM

[75] Inventor: Leo M. Klisch, Falcon Heights, Minn.

[73] Assignee: Minnesota Mining and Manufacturing Company, St. Paul, Minn.

[21] Appl. No.: 771,268

[22] Filed: Aug. 30, 1985

Related U.S. Application Data

[63] Continuation of Ser. No. 586,200, Mar. 5, 1984, abandoned.

[51] Int. Cl.[4] ..... B26D 1/00

[52] U.S. Cl. ..... 83/694; 30/231

[58] Field of Search ..... 30/231, 296 R, 241-243; 83/582, 583, 644, 694

[56] References Cited

U.S. PATENT DOCUMENTS 1,326,460 12/1919 Lorenz ..... 83/694

3,039,343 6/1962 Richards ..... 83/694 X

FOREIGN PATENT DOCUMENTS 1322529 7/1973 United Kingdom .

*Primary Examiner*—Douglas D. Watts

*Attorney, Agent, or Firm*—Donald M. Sell; James A. Smith; John C. Barnes

[57] ABSTRACT

A cutting mechanism adapted for paper can be formed from sheet metal and cooperate with an anvil having a straight edge wherein the blade has the cutting surface which tapers toward the opposite edge of the blade and the metal is bent from the plane of the blade along the tapered edge at a progressively greater angle.

9 Claims, 2 Drawing Figures

CUTTING MECHANISM

This is a continuation of application Ser. No. 586,200 filed Mar. 5, 1984 now abandoned.

BACKGROUND OF THE INVENTION

1. Field of the Invention

This invention relates to an improvement in cutting mechanisms, particularly cutting mechanisms adapted to cut sheets of paper from a roll and to produce the cutting members from stamped pieces from sheet metal.

2. Description of the Prior Art

The field is full of paper cutting devices which utilize a vertically reciprocating blade and a fixed anvil, and typically the blade is formed with a taper in the blade from one edge to the other with the blade stock being finished to provide a sharp cutting edge adjacent the anvil. It is further typical to have a blade member which is spring biased toward the anvil, and which when moved, in a plane perpendicular to the anvil, actually moves across the anvil in such a way as to progressively cut the sheet material across the width of the sheet.

In each of these cutting devices however the blade has been finished to provide a cutting edge along the blade which provides a sharpened cutting edge which cooperates with either a similarly sharpened edge on the anvil or which cooperates with an edge of the anvil.

In the prior art devices the blade stock has required considerable working to provide a blade which would have sufficient life to be utilized in equipment such as copying machines, duplicating machines, and other printing equipment.

The present invention provides a cutting mechanism wherein the formation of the blade is a one-step stamping operation and the blade is readily positioned in a cutting mechanism and adapted for reciprocating cutting motion with respect to a similar anvil stamped from sheet metal.

SUMMARY OF THE INVENTION

The present invention relates to a cutting mechanism, and particularly to a paper shear utilizing a reciprocating blade and anvil. The anvil provides support for a sheet of material to be cut and the blade comprises a generally planar rectangular piece of sheet metal having a working face disposed toward the anvil and defined by a top edge, opposite side edges, and a bottom edge which tapers toward the top edge from a point adjacent a side edge, and said sheet metal is progressively angularly bent along the bottom edge from adjacent said side edge to the point closest to the top edge in a direction toward the anvil, such that as the blade moves vertically in the plane of the blade the bottom edge contacts a point on the anvil which moves progressively across the anvil to cut the sheet material.

The knife's cutting edge is formed by this bend in the bottom edge of the blade, and the bend in the blade varies from a minimum angle adjacent one edge and progresses angularly toward the top edge, and preferably the maximum bend is at a midpoint of the blade as the bottom edge will taper from the two side edges toward the center portion of the blade to reduce vertical movement necessary to cut the sheet material.

The preferred angle of taper of the bottom edge is seventeen (17) degrees at the center of the blade with the angle being such as to increase the total thickness of the blade adjacent the bottom edge by 100% to 175% of the thickness of the sheet metal at the center.

BRIEF DESCRIPTION OF THE DRAWING

Referring now to the drawings, the invention will further be described wherein.

DETAILED DESCRIPTION OF THE INVENTION

The present invention provides an improved cutting mechanism for use with paper-like material and to an improved blade construction which reduces the cost of manufacture of the blade by removing the need for finishing the cutting edge.

Figure 1:
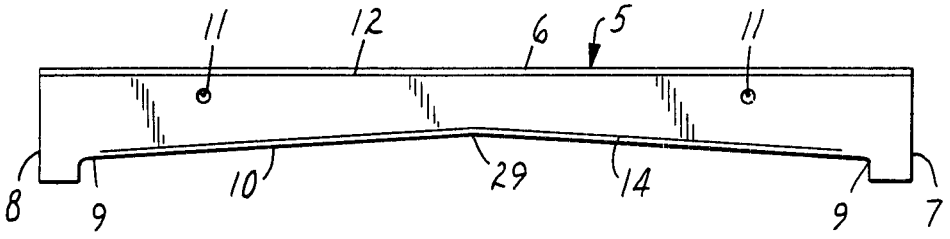
FIG. 1 is an elevational view of the cutting blade of the present invention.

The cutting blade 5 is indicated in FIG. 1 and is formed from a sheet of blue tempered polished steel, preferably 0.020 inch thick, and having an overall dimension of 13.62 inches by 1.8 inches, and being generally rectangular in shape. The blade is formed with a top edge 6, side edges 7 and 8 which connect the top edge 6 to the bottom edge 10. The bottom edge 10 extends from the side edges 7 and 8, and from points 9 adjacent the side edges 7 and 8 begins to taper toward the top edge 6 from each side to define a cutting edge. The bottom edge is inset from the bottom of the blade 5 and defines a broad inverted v-shaped cutting edge. Openings 11 are formed in the blade 5 at two spaced locations to receive the operating mechanism. The top edge 6 is formed with a slight bend at the line 12 to place rigidity in the top edge of the blade.

Figure 2:
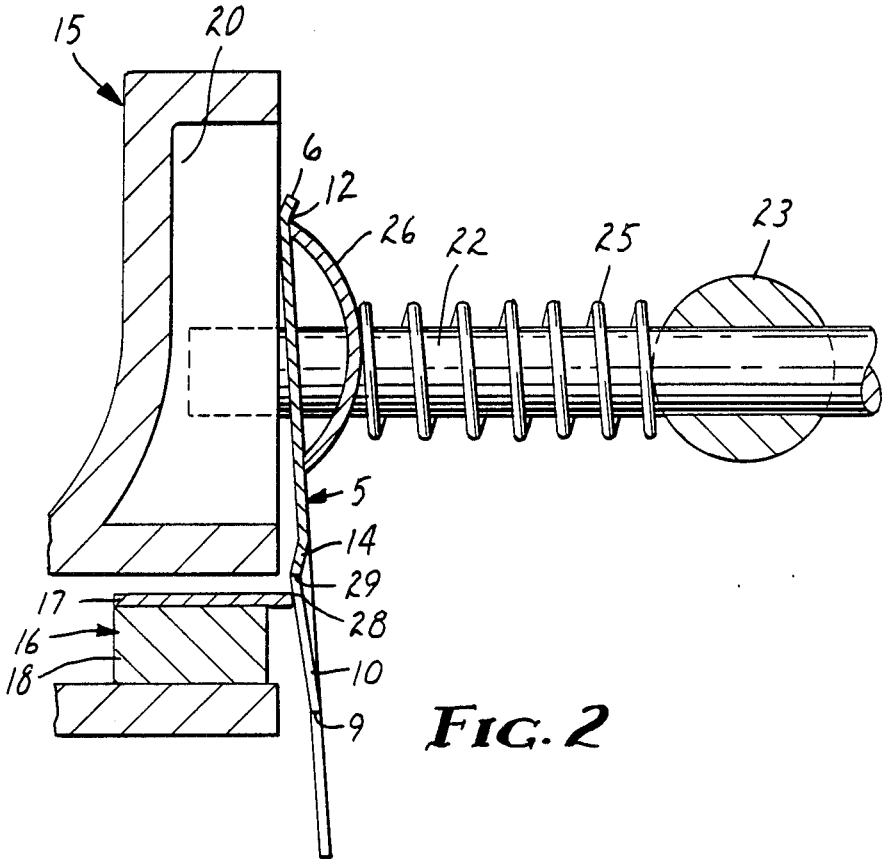
FIG. 2 is a cross sectional view of the cutting mechanism including the cutting blade and anvil.

The bottom edge 10 of the blade is offset outward from the working face of the blade by bending the sheet metal from points 9 adjacent the side edges 7 and 8 to a position of maximum bend where the tapered bottom edge 10 is nearest the top edge 6. The bend is made in the blade as indicated in FIG. 2 along a line spaced about 0.1 inch from the edge 10 as indicated at 14, and the angle or amount of bend progresses as shown in FIG. 2 from 0 to 5 degrees near the side edge point 9 to an angle of about seventeen (17) degrees at the maximum point or center point of the blade 5. This bend will increase the thickness of the blade 5 at the point 29 by 100 to 175% or to between about 0.040 inch to 0.055 inch and preferably 0.045 inch.

The bend in the blade is designed so that the force applied between the knife and the anvil is concentrated at two cutting points as the blade is moved in the plane of the blade relative to the anvil. Referring particularly now to FIG. 2 it will be seen that blade 5 is supported against a fixed beam 15 positioned in spaced relation above an anvil member 16. The anvil member 16 comprises an upper anvil 17 formed of polished tempered steel sheet material about 0.020 inch thick mounted on a support block 18. The anvil 17 has an edge 28 which projects or is spaced from the support block 18 and beyond the plane of beam 15.

The blade 5 is positioned for movement relative to the anvil 17 and support beam 15 which has recessed areas 20 positioned between vertical walls along the length thereof to receive the free ends of a pair of radially extending pins 22 which are fixed in a rotatable shaft 23 driven by an operating mechanism not shown. Rotation of the shaft 23 causes the vertical movement of the blade 5 as the pair of radial pins 22 extending through the openings 11 of the blade move the blade. A helical spring member 25 positioned over each pin 22 forces a bar 26 of generally semi-cylindrical shape against the back surface of the blade 5 to maintain the blade in the plane of and in contact with the planar face of the beam 15. As illustrated in FIG. 2, the shaft 23 has rotated counterclockwise through an angle of approximately 15 degrees to slide the blade 5 in relation to the beam 15 to move the blade 5 downwardly such that the edge 10 has moved along the cutting edge 28 of the anvil 17 to effectively begin the shear of any sheet material which may be supported on the upper surface of the anvil 17. As the blade continues to move downwardly the cutting points will move transversely across the sheet material to the center point 29 of the blade 5 to end the cut.

As the blade is reciprocated vertically with respect to the anvil 17 the bottom edge 10 is maintained in contact at two points with the edge 28 of the anvil 17, and the depending portions of the blade 5 adjacent the edges 7 and 8 maintain contact with the anvil 17 and/or support 18. Flexure of the blade 5 maintains the bottom edge 10 in cutting engagement. The illustration in FIG. 2 does not illustrate the blade flexure as it illustrates the bend in the blade contacting the anvil edge 28 and forcing the edges away from the anvil. This is not accurate as the blade actually bows lengthwise.

The blade 5 is formed by a stamping operation to cut the blade 5 from a piece of sheet material having a thickness of approximately 0.020 inch. The stamping of the blade also forms the bend in the bottom edge 10 and along the top edge 6. The burr edge resulting from the stamping is on the working face positioned against the beam 15. The bend along the bottom edge is defined to provide the desired bend angle in this blade. The normal resilience of the sheet material will cause a flexing of the blade 5 as the blade continues its downward movement across the anvil member 17 and an obstruction will cause a movement of the blade and a rocking or flexing against the compression spring 15 to restrict extensive damage to the blade.

Having thus described the present invention what is defined as applicant's invention is set forth in the appended claims.

I claim:

1. A paper shear comprising an anvil to support a sheet of material to be cut transversely, said anvil having a corner defining an anvil edge for cooperation with a blade and along which the material will be cut, a generally planar rectangular blade of thin sheet metal having a working face defined by a top edge, opposite side edges and a bottom edge which tapers toward said top edge from a point adjacent at least one side edge, said sheet metal being formed with a bend along a line parallel to said bottom edge, the amount of said bend being progressively greater from said one side edge toward said top edge, said bend being directed from the plane of the blade toward said anvil to increase the thickness of said blade by 100 to 175 percent and to define the cutting edge along the working face which will maintain contact with said anvil at least at one point upon vertical movement of said blade in the plane of said working face and, means for biasing said blade toward said anvil.

2. A paper shear according to claim 1 wherein said bottom edge tapers from adjacent each side edge toward said top edge.

3. A paper shear according to claim 2 wherein said sheet metal is 0.020 inch thick.

4. A paper shear according to claim 1 wherein said sheet metal is 0.020 inch thick.

5. A paper shear according to claim 1 wherein said anvil comprises a rectangular piece of sheet material with one edge defining said anvil edge.

6. A paper shear according to claim 5 wherein said bottom edge of said blade tapers from both said side edges toward said top edge.

7. A paper shear according to claim 6 wherein said anvil and said blade comprise 0.020 inch sheet material.

8. A paper shear according to claim 7 wherein said blade along said bottom edge has a thickness of between 0.020 and 0.045 inch from a side edge toward the narrowest part of said blade.

9. A paper shear according to claim 1 wherein said blade has a burr formed along the bottom edge of the working face resulting from the stamping of the blade from a sheet of thin sheet steel.

* * * * *